US008761655B2

(12) United States Patent
Yamamoto et al.

(10) Patent No.: US 8,761,655 B2
(45) Date of Patent: Jun. 24, 2014

(54) WASTE TONER RECOVERY UNIT

(75) Inventors: Masanobu Yamamoto, Osaka (JP); Takashi Tokuda, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 193 days.

(21) Appl. No.: 13/368,474

(22) Filed: Feb. 8, 2012

(65) Prior Publication Data

US 2012/0213568 A1 Aug. 23, 2012

(30) Foreign Application Priority Data

Feb. 21, 2011 (JP) ..... 2011-034067

(51) Int. Cl.
*G03G 21/00* (2006.01)
*G03G 21/12* (2006.01)

(52) U.S. Cl.
USPC ..... 399/358; 399/360

(58) Field of Classification Search
USPC ..... 399/35, 120, 360
See application file for complete search history.

(56) References Cited

FOREIGN PATENT DOCUMENTS

| | | | | |
|---|---|---|---|---|
| JP | 62-129568 | U | | 8/1987 |
| JP | 05-303311 | A | | 11/1993 |
| JP | 05303311 | A | * | 11/1993 |
| JP | 2001-249594 | A | | 9/2001 |

* cited by examiner

*Primary Examiner* — Clayton E Laballe
*Assistant Examiner* — Jas Sanghera
(74) *Attorney, Agent, or Firm* — Renner, Otto, Boisselle & Sklar, LLP

(57) ABSTRACT

A waste toner recovery unit includes a waste toner conveying screw, a coating member, and a waste toner storing portion. The waste toner conveying screw has a first end and a second end and conveys waste toner, the first end being linked with a driving portion and the second end being set as a free end. The coating member coats the free end of the waste toner conveying screw by being fitted in a processing unit, has an opening to which waste toner conveyed by the waste toner conveying screw falls down, and can rotate in such a way that the opening is positioned in a vertically lower part. The waste toner storing portion stores the waste toner which falls down from the opening.

6 Claims, 12 Drawing Sheets

WASTE TONER RECOVERY UNIT

CROSS REFERENCE

This Nonprovisional application claims priority under 35 U.S.C. §119(a) on Patent Application No. 2011-034067 filed in Japan on Feb. 21, 2011, the entire contents of which are hereby incorporated by reference.

BACKGROUND OF THE INVENTION

The present invention relates to a waste toner recovery unit for recovering waste toner.

Generally, an image forming apparatus is provided with a waste toner recovery unit for recovering waste toner which has been deteriorated after being used at a transfer process. This type of waste toner recovery unit is detachably installed to the image forming apparatus body, and, when the amount of toner which has been recovered has reached a certain constant amount and when maintenance is being performed, the waste toner recovery unit is removed from the image forming apparatus body and exchanged.

Some waste toner recovery units are provided with a waste toner recovery container and a rotary type shutter for switching between an opened state and a closed state of a waste toner discharge port of the image forming apparatus body. That is to say, by switching a position of the rotary type shutter from a closed position to an opened position, the waste toner discharge port and the waste toner recovery container of the image forming apparatus body are brought into communication with each other, and guide the waste toner conveyed from the image forming apparatus body to the inside of the waste toner recovery container.

In recent years, a structure has been developed for switching between an opened state and a closed state by manual rotation of an inside cylinder in a part called a joint portion where the inside cylinder in which a waste toner discharge port is formed in an outer peripheral surface thereof is rotatably incorporated into the inside of an outside cylinder in which a toner discharge port is formed in an outer peripheral surface thereof and which is placed in a fixed position (refer to Patent Document 1: Japanese Patent Laid-Open Publication No. 2001-249594, for example). In this structure, a waste toner recovery unit without occurrence of leakage of waste toner at such a joint portion and with excellence in operability can be obtained.

However, the Patent Document 1 does not disclose the structure described in the Patent Document 1 causes deterioration in operability accompanying torque increase when the rotary type shutter is rotated due to the effects such as a toner clog in the joint portion between the image forming apparatus body and the rotary type shutter. That is, in the end surface at a base end in which the rotary type shutter is connected to the image forming apparatus body, a toner clog occurs as the duration of use of the image forming apparatus body becomes longer, thereby increasing torque in rotating the rotary type shutter for switching between an opened state and an closed state and causing the deterioration of operability.

In view of the foregoing problems, it is an object of the present invention to provide a waste toner recovery unit capable of preventing the operability from being deteriorated even by the use over a long period of time.

SUMMARY OF THE INVENTION

A waste toner recovery unit according to the present invention includes a waste toner conveying screw, a coating member, and a waste toner storing portion. The waste toner conveying screw has: a first end linked with a driving portion; and a second end set as a free end, and conveys waste toner. The coating member coats the free end of the waste toner conveying screw by being fitted in a processing unit. Moreover, the coating member has an opening to which waste toner conveyed by the waste toner conveying screw falls down, and can rotate in such a way that the opening may be positioned in a vertically lower part. The waste toner storing portion stores the waste toner which falls down from the opening.

In addition, the coating member has at least one cutout portion formed at an end of a sliding surface of a fitting portion which is fitted in the processing unit.

The foregoing and other features and attendant advantages of the present invention will become more apparent from the reading of the following detailed description of the invention in conjunction with the accompanying drawings.

DETAILED DESCRIPTION OF THE INVENTION

Hereinafter, a waste toner recovery unit according to embodiments of the present invention will be described in detail with reference to the drawings.

To begin with, description will be made of a first embodiment of the present invention.

Figure 1:
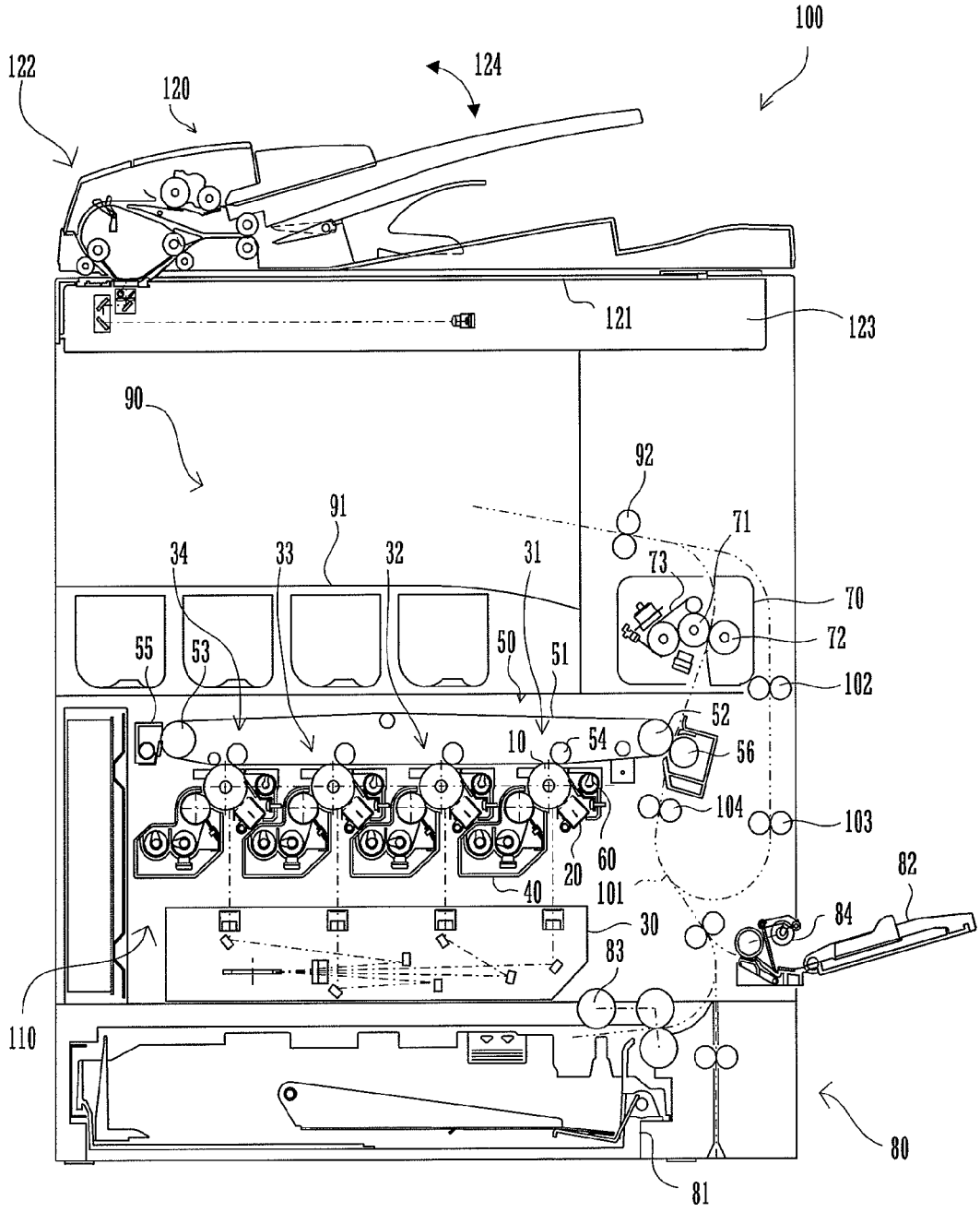
FIG. 1 is a front view illustrating a configuration of an image forming apparatus provided with a waste toner recovery unit according to a first embodiment of the present invention.

FIG. 1 is a front view of a configuration of an image forming apparatus 100 provided with a waste toner recovery unit 200 according to the first embodiment of the present invention.

In FIG. 1, although the waste toner recovery unit 200 is omitted, the image forming apparatus 100 is provided with the waste toner recovery unit 200.

The image forming apparatus 100 is configured to form a polychrome or monochrome image on a predetermined sheet in accordance with image data transmitted thereto from the outside. The image forming apparatus 100 includes a document processing device 120, a paper feeding portion 80, an image forming portion 110, and a paper output portion 90.

The document processing device 120 includes a document platen 121, a document feeder 122, and a document reading portion 123. The document platen 121 is formed of transparent glass and is designed to allow a document to be placed thereon. The document feeder 122 feeds documents loaded on a document tray one by one. The document feeder 122, which is capable of rotating in a direction indicated by an arrow 124, allows a document to be placed on the document platen 121 by opening the top surface of the document platen 121. The document reading portion 123 reads a document being fed by the document feeder 122 or a document placed on the document platen 121.

The paper feeding portion 80 includes a paper feeding cassette 81, a manual paper feeding cassette 82, a pick-up roller 83, and a pick-up roller 84. The paper feeding cassette 81 is a tray for storing standard size sheets therein. The manual paper feeding cassette 82 is a tray capable of placing non-standard size sheets thereon. The pick-up roller 83, which is located adjacent to an end portion of the paper feeding cassette 81, picks up sheets one by one from the paper feeding cassette 81 to feed each sheet into a paper feed path 101. Similarly, the pick-up roller 84, which is located adjacent to an end portion of the manual paper feeding cassette 82, picks up sheets one by one from the manual paper feeding cassette 82 to feed each sheet into the paper feed path 101.

The image forming section 110 includes processing units 31, 32, 33, and 34, an exposure unit 30, an intermediate transfer belt unit 50, and a fixing unit 70. Each of the processing units 31, 32, 33, and 34 includes a photoreceptor drum 10, an electrostatic charger 20, a developing device 40, and a cleaner unit 60. The processing units 31, 32, 33, and 34 correspond to respective colors, namely, black (K), cyan (C), magenta (M), and yellow (Y) and are each adapted to form a color image by using a respective one of the colors. Hereinafter, in a case where the processing units 31, 32, 33, and 34 are described, description is directed to the processing unit 31 as a representative example of the processing units.

The photoreceptor drum 10 rotates during image formation to bear a developer image thereon. Around the photoreceptor drum 10 are disposed the electrostatic charger 20, the exposure unit 30, the developing device 40, the intermediate transfer belt unit 50 and the cleaner unit 60 in this order from an upstream side in the direction of rotation of the photoreceptor drum 10. The fixing unit 70 is provided on the paper feed path 101 at a position most downstream in the image forming section 110.

The electrostatic charger 20 is means for uniformly charging a peripheral surface of the photoreceptor drum 10 to a predetermined electrical potential. The exposure unit 30 has a function of exposing the photoreceptor drum 10 in an electrostatically charged state to light according to image data inputted, thereby forming an electrostatic latent image according to the image data on the peripheral surface of the photoreceptor drum 10. The developing device 40 is configured to visualize with toner the electrostatic latent image formed on the photoreceptor drum 10.

The intermediate transfer belt unit 50 includes an intermediate transfer belt 51, an intermediate transfer belt driving roller 52, an intermediate transfer belt idle roller 53, an intermediate transfer roller 54, and an intermediate transfer belt cleaning unit 55.

The intermediate transfer belt driving roller 52, the intermediate transfer belt idle roller 53 and the intermediate transfer roller 54 are configured to drive the intermediate transfer belt 51 for rotation while stretching the intermediate transfer belt 51 therebetween. The intermediate transfer roller 54 gives a transfer bias to transfer a toner image on the photoreceptor drum 10 onto the intermediate transfer belt 51. The intermediate transfer belt 51 is positioned so as to contact the photoreceptor drum 10. The intermediate transfer belt 51 has a function of forming a toner image on the intermediate transfer belt 51 by transferring the toner image formed on the photoreceptor drum 10 onto the intermediate transfer belt 51.

As stated above, electrostatic latent images visualized on the respective photoreceptor drum 10 are transferred onto the intermediate transfer belt 51 so as to be superimposed on one another. Image information obtained by superimposing the toner images is moved by rotation of the intermediate transfer belt 51 to a contact position between a paper sheet and the intermediate transfer belt 51 and is then transferred onto the paper sheet by a transfer roller 56 disposed at the contact position. At this time, the intermediate transfer belt 51 and the transfer roller 56 are brought into contact with each other by pressurizing at a predetermined nip while a voltage (a high voltage having a polarity (+) opposite to the polarity (−) of charged toner) is applied to the transfer roller 56 for transferring of the toner onto the paper sheet.

Toner adhered to the intermediate transfer belt 51 by contacting the photoreceptor drum 10 as stated above or residual toner remaining on the intermediate transfer belt 51 without having been transferred onto the paper sheet by the transfer roller 56, is removed and recovered by the intermediate transfer belt cleaning unit 55.

The cleaner unit 60 removes and recovers the residual toner remaining on the peripheral surface of the photoreceptor drum 10 after the image transferring process following the developing process. The fixing unit 70 includes a heating roller 71 and a pressure roller 72. The heating roller 71 and the pressure roller 72 are configured to rotate while sandwiching a sheet therebetween. An external heating belt 73 is further provided for heating the heating roller 71 from the outside.

The paper output portion 90 has a paper output tray 91 and a paper output roller 92. The sheet having passed through the fixing unit 70 is output onto the paper output tray 91 by passing between the paper output rollers 92. The paper output tray 91 is a tray for accumulating sheets finished with printing.

In a case where double-side printing is requested, when a sheet having been finished with single-side printing as described above and passed through the fixing unit 70 is held between the sheet output rollers 92 at the rear edge of the sheet, the sheet output rollers 92 rotate backwardly to feed the sheet to feed rollers 102 and then to feed rollers 103. Thereafter, the sheet is subjected to reverse side printing after having passed between registration rollers 104 and is then outputted to the paper output tray 91.

Figure 2:
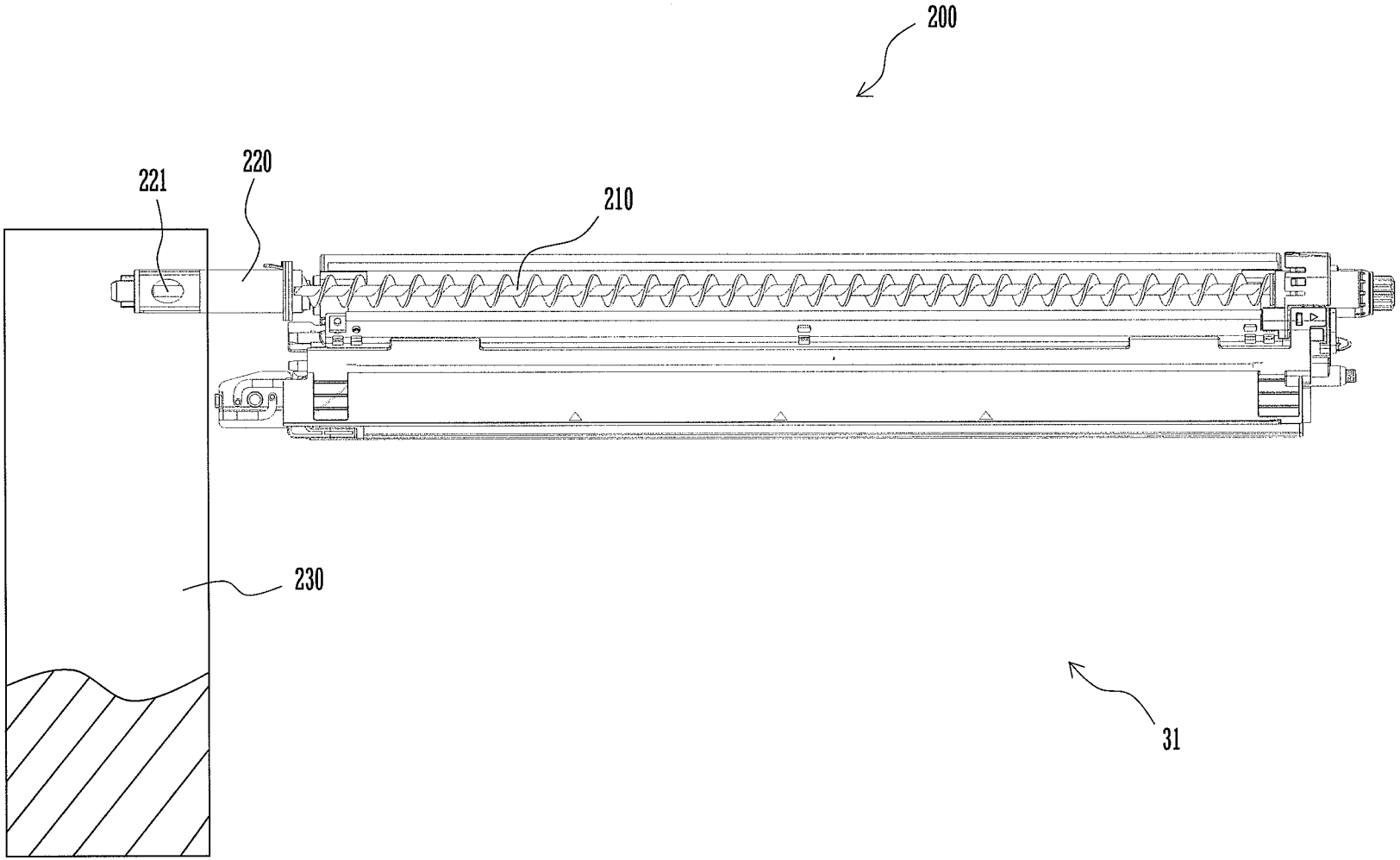
FIG. 2 is a view illustrating a configuration of the waste toner recovery unit according to the first embodiment of the present invention.
Figure 3:
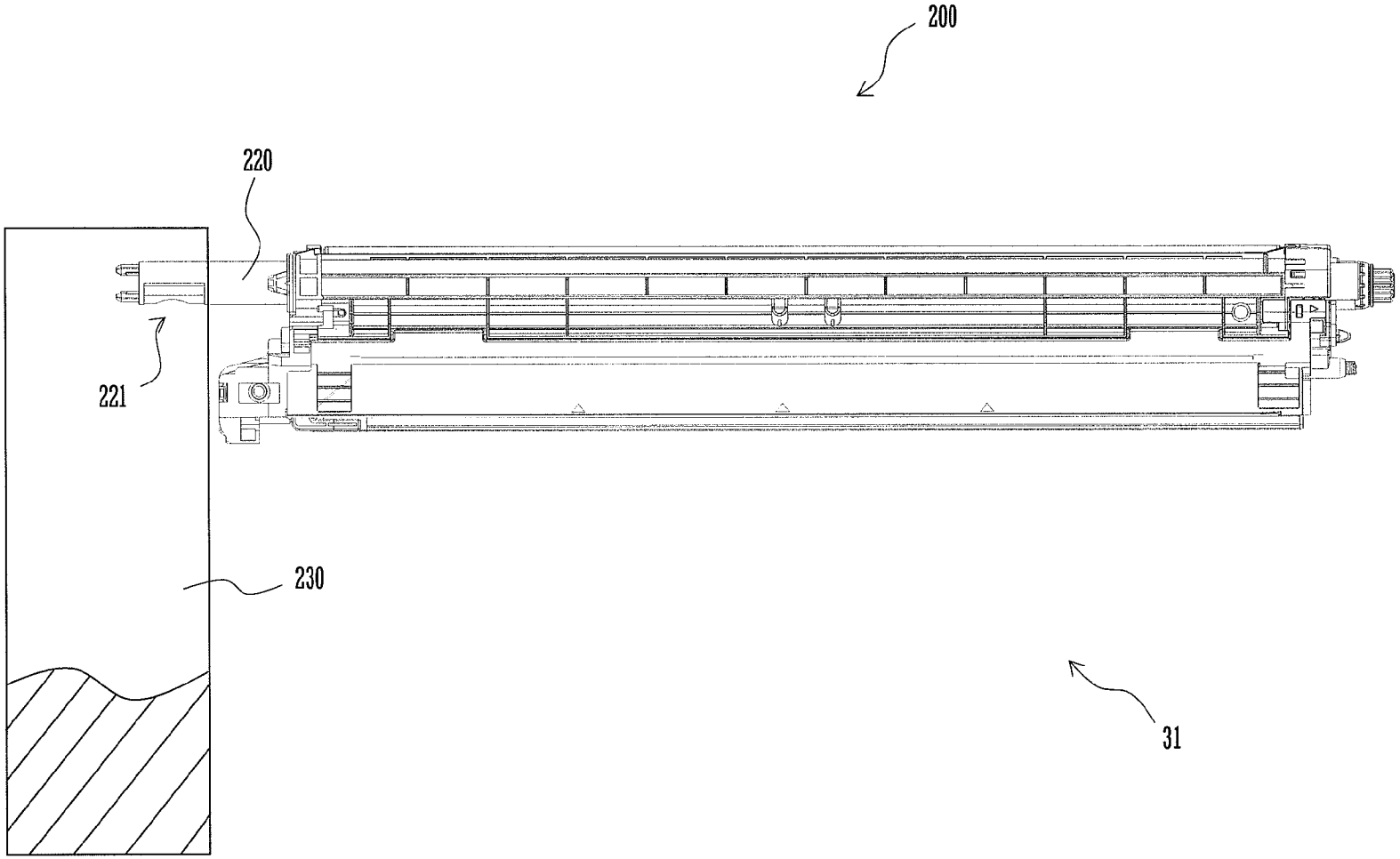
FIG. 3 is a view illustrating a configuration of the waste toner recovery unit according to the first embodiment of the present invention.
Figure 4:
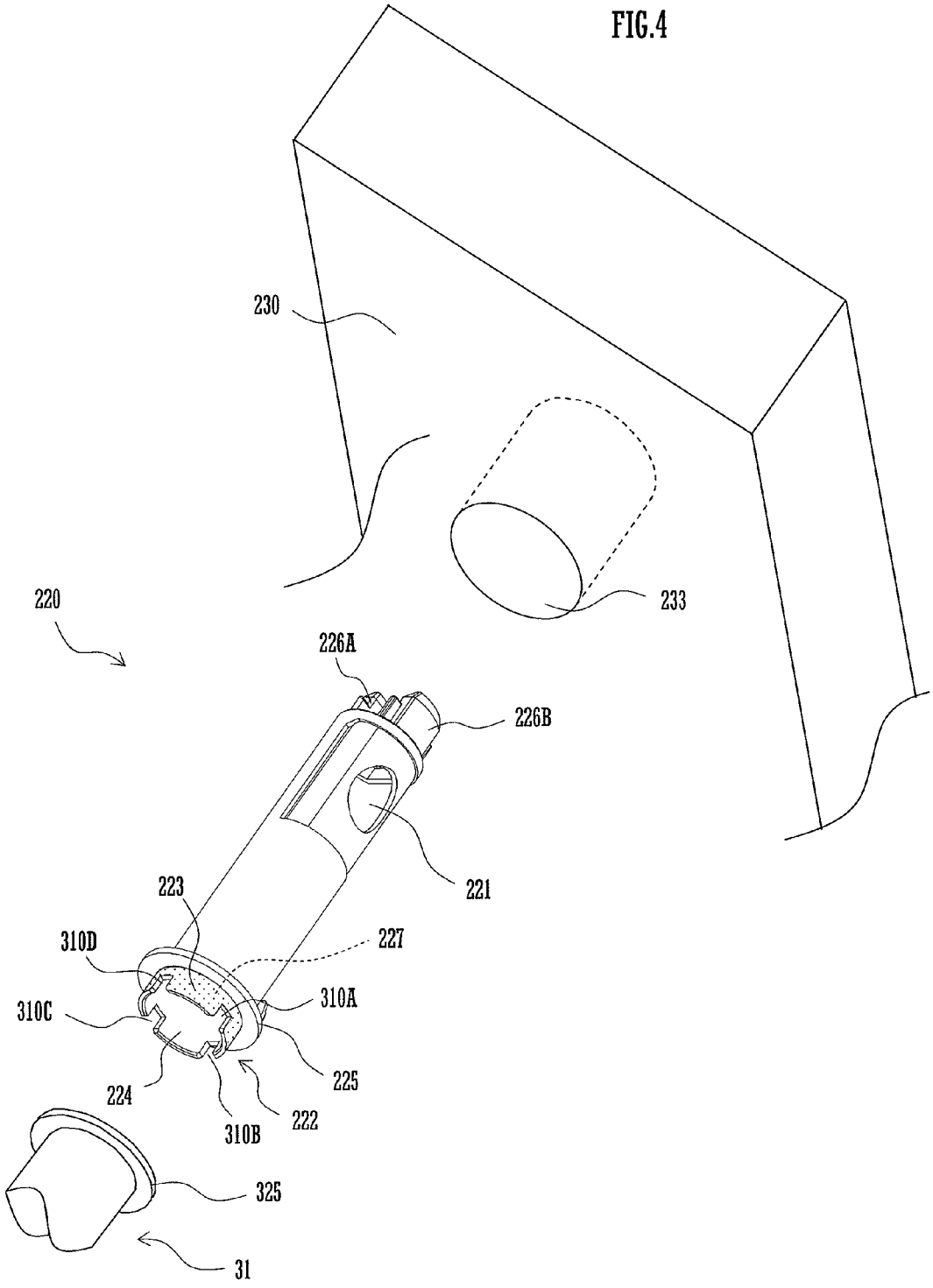
FIG. 4 is a view illustrating a configuration of a coating member in the waste toner recovery unit according to the first embodiment of the present invention.

FIG. 2 is a view of a configuration of the waste toner recovery unit 200 according to the first embodiment of the present invention. FIG. 3 is a view of a configuration of the waste toner recovery unit 200 according to the first embodiment of the present invention. FIG. 4 is a view of a configuration of a coating member 220 in the waste toner recovery unit 200 according to the first embodiment of the present invention.

The waste toner recovery unit 200 is provided with a waste toner conveying screw 210, a coating member 220, and a waste toner storing portion 230. The waste toner conveying screw 210 has a first end linked with a driving portion and a second end set as a free end and is a member for conveying waste toner. In the present embodiment, the second end is positioned at the tip portions 226A and 226B in the coating member 220, and the first end is positioned at an end opposite to the second end.

The coating member 220 coats the free end side of the waste toner conveying screw 210 by being fitted in a processing unit 31, has an opening 221 to which waste toner conveyed by the waste toner conveying screw 210 falls down, and can rotate in such a way that the opening 221 may be positioned in a vertically lower part. The waste toner storing portion 230 stores the waste toner which falls down from the opening 221. It is to be noted that the coating member 220 is inserted in a hole 233 of the waste toner storing portion 230.

In addition, the coating member 220 has at least one cutout portion 310 formed at an end of the sliding surface 223 of the fitting portion 222 which is fitted in the processing unit 31. The present embodiment adopts a configuration in which the coating member has four cutout portions 310. In each drawing, reference numerals A to D are used, but the reference numerals A to D are omitted in the description of the present embodiment unless there are considerable circumstances.

In this configuration, since penetrating toner 227 which has been accumulated in the fitting portion 222 between the processing unit 31 and the coating member 220 can be scraped by the cutout portion 310 when the coating member 220 is rotated, the amount of the penetrating toner 227 which has been accumulated in the fitting portion 222 can be decreased. Thus, increase of the rotation torque accompanying the increase in the number of times of rotation of the coating member 220 can be prevented.

Therefore, the waste toner recovery unit 200 according to the present embodiment can prevent operability from being deteriorated even when being used over a long period of time.

In this configuration, at least one of the cutout portions 310 is preferably formed in a position where the cutout portion can pass through a vertically lower part by rotation of the coating member 220.

The penetrating toner 227 is likely to be accumulated in a vertically lower portion in the fitting portion 222 by the weight thereof. Thus, in this configuration, since the penetrating toner 227 which has been accumulated in a vertically lower portion of the fitting portion 222 can be scraped by the cutout portion 310 when the coating member 220 is rotated, the amount of the penetrating toner 227 which has been accumulated in the fitting portion 222 can be greatly decreased. Accordingly, increase of the rotation torque accompanying the increase in the number of times of rotation of the coating member 220 can be prevented.

Therefore, the waste toner recovery unit 200 according to the present embodiment can prevent operability from being deteriorated even when being used over a long period of time.

In addition, according to the present embodiment, the cutout portion 310 is formed so that the sliding surface 223 and an opposite side surface 224 can communicate with each other.

In this configuration, the penetrating toner 227 scraped by the cutout portion 310 when the coating member 220 is rotated is moved from the sliding surface 223 to the opposite side surface 224 through the cutout portion 310, so that the waste toner conveying screw 210 can convey the penetrating toner 227 to the waste toner storing portion 230.

Moreover, in this configuration, increase of the rotation torque accompanying the increase in the number of times of rotation of the coating member 220 can be prevented even when the coating member 220 is repeatedly rotated since the penetrating toner 227 scraped by the cutout portion 310 is not accumulated in the cutout portion 310 when the coating member 220 is rotated.

Therefore, the waste toner recovery unit 200 according to the present embodiment can prevent operability from being deteriorated even when being used over a long period of time.

Furthermore, the coating member 220 has a sealing portion 225 for preventing the penetrating toner 227 from leaking from the fitting portion 222. The cutout portion 310 is preferably formed so as not to reach the sealing portion 225.

The sealing portion 225 has a flange shape. A sealing portion 325 of the processing unit 31 also has a flange shape. When the coating member 220 is fitted in the processing unit 31, the sealing portion 225 and the sealing portion 325 are brought into slidable contact with each other.

The penetrating toner 227 which penetrates into the fitting portion 222 passes through the sliding surface 223, and may start leaking to the outside along the surface of the sealing portion 225. In order to prevent the leakage of the penetrating toner 227, the fitting portion 222 may preferably increase the length thereof in the axial direction. Therefore, in this configuration, since the cutout portion 310 is formed so as not to reach the sealing portion 225, the penetrating toner 227 which penetrates into the fitting portion 222 can be prevented from leaking to the outside along the surface of the sealing portion 225.

The cutout portion 310 is also preferably arranged at every predetermined angle according to a rotatable angle of the coating member 220.

Since a small rotatable angle of the coating member 220 reduces action to move the penetrating toner 227 which has penetrated into the sliding surface 223 of the fitting portion 222 to the opposite side surface 224, action to output the penetrating toner 227 needs to be facilitated by placing a number of the cutout portions 310. In contrast, since a large rotatable angle of the coating member 220 improves action to move the penetrating toner 227 which has penetrated into the sliding surface 223 of the fitting portion 222 to the opposite side surface 224, action to output the penetrating toner 227 can be secured even if the number of the cutout portions 310 is reduced.

Accordingly, increase of the rotation torque accompanying the increase in the number of times of rotation of the coating member 220 can be prevented. Therefore, the waste toner recovery unit 200 according to the present embodiment can prevent operability from being deteriorated even when being used over a long period of time.

The cutout portion 310 is further preferably arranged at every angle equal to a rotatable angle of the coating member 220.

That is to say, in a case where the rotatable angle of the coating member 220 is 120 degrees, three cutout portions 310 may be provided in the sliding surface 223 at equal intervals, whereas in a case where the rotatable angle of the coating member 220 is 90 degrees, four cutout portions 310 may be provided in the sliding surface 223 at equal intervals.

In this configuration, over the entire perimeter of the sliding surface 223, the penetrating toner 227 which has penetrated into the sliding surface 223 of the fitting portion 222 can be moved to the opposite side surface 224. Accordingly, increase of the rotation torque accompanying the increase in the number of times of rotation of the coating member 220 can be prevented.

Therefore, the waste toner recovery unit 200 according to the present embodiment can prevent operability from being deteriorated even when being used over a long period of time.

The cutout portion 310 has a rectangular shape.

In this configuration, since the width in a circumferential direction is widely secured, the penetrating toner 227 which has been accumulated in the fitting portion 222 between the processing unit 31 and the coating member 220 can be scraped effectively when the coating member 220 is rotated. Accordingly, increase of the rotation torque accompanying the increase in the number of times of rotation of the coating member 220 can be prevented.

Therefore, the waste toner recovery unit 200 according to the present embodiment can prevent operability from being deteriorated even when being used over a long period of time.

Figure 5:
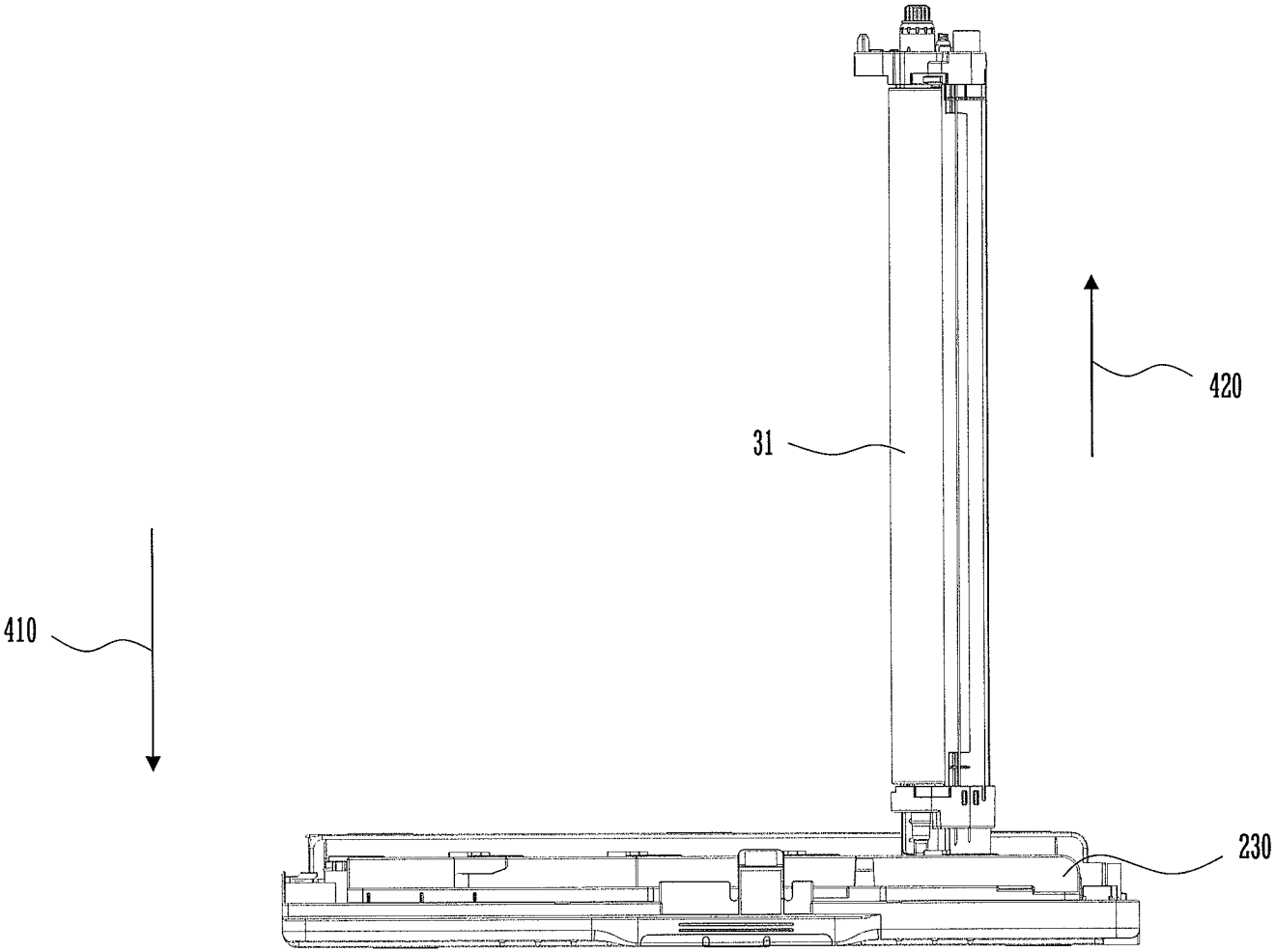
FIG. 5 is a view showing a relationship between the waste toner storing portion of the waste toner recovery unit and processing unit according to the first embodiment of the present invention.

FIG. 5 is a view showing a relationship between the waste toner storing portion 230 of the waste toner recovery unit 200 and a processing unit 31 according to the first embodiment of the present invention.

The processing unit 31, when being under use, is linked with the waste toner storing portion 230, as shown in FIG. 5, in order to recover the waste toner conveyed from the cleaner unit 60. In order to link the processing unit 31 with the waste toner storing portion 230, the processing unit 31 is moved in a direction indicated by an arrow 410 while the processing unit 31 is moved in a direction indicated by an arrow 420 in order to detach the processing unit 31 from the waste toner storing portion 230. It is to be noted that the processing unit 31 cannot be moved in the direction indicated by the arrow 420 in a case where the processing unit 31 is in use.

Figure 6:
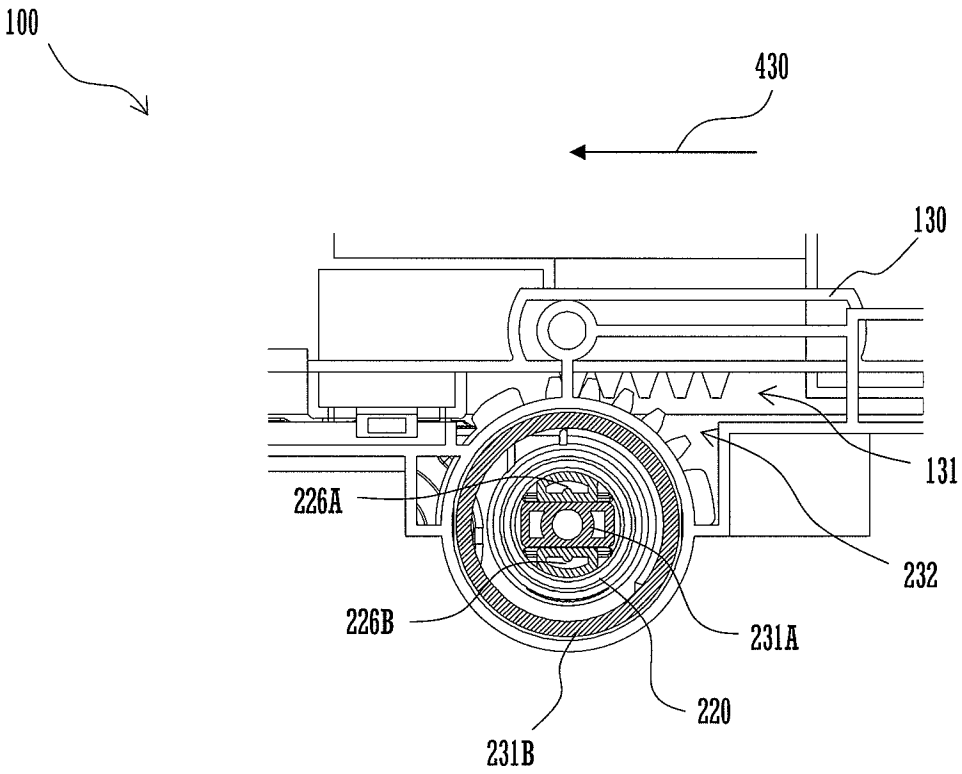
FIG. 6 is a view showing a relationship between the coating member and the waste toner storing portion of the waste toner recovery unit according to the first embodiment of the present invention.
Figure 7:
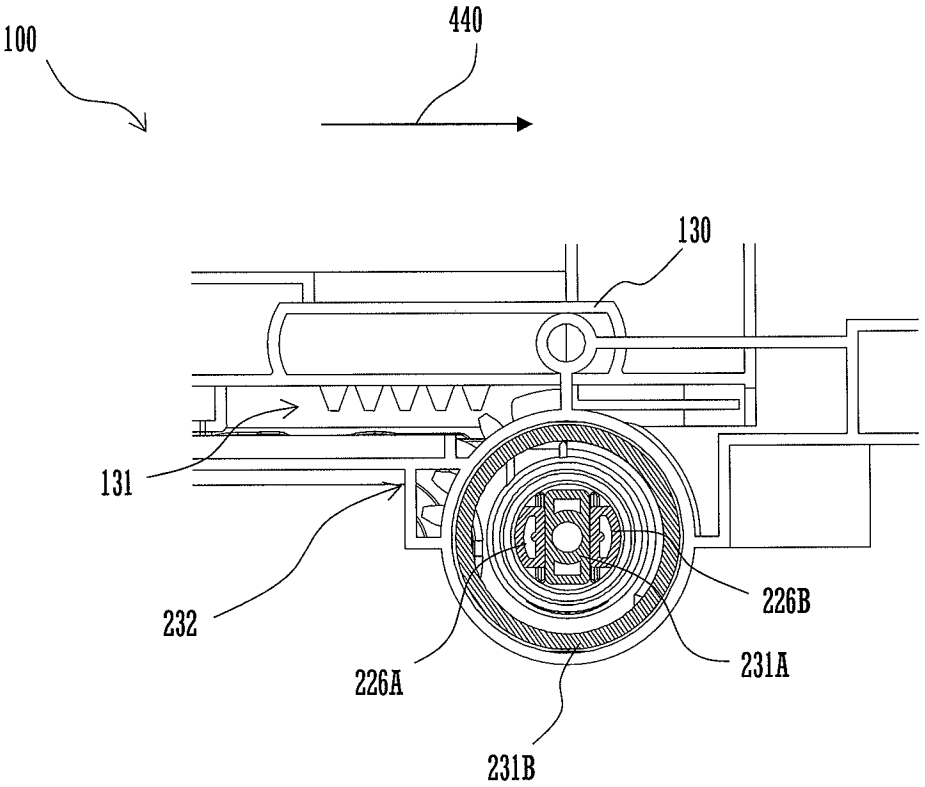
FIG. 7 is a view showing a relationship between the coating member and the waste toner storing portion of the waste toner recovery unit according to the first embodiment of the present invention.

FIG. 6 is a view showing a relationship between the coating member 220 and the waste toner storing portion 230 of the waste toner recovery unit 200 according to the first embodiment of the present invention. FIG. 7 is a view showing a relationship between the coating member 220 and the waste toner storing portion 230 of the waste toner recovery unit 200 according to the first embodiment of the present invention.

FIG. 6 shows a state where the opening 221 of the coating member 220 is positioned in a vertical lower part, whereas FIG. 7 shows a state where the opening 221 of the coating member 220 is positioned in a part other than the vertical lower part.

This configuration is now described below. A shutter 231A of the waste toner storing portion 230 enters between the tip portion 226A and the tip portion 226B of the coating member 220. A shutter 231B of the waste toner storing portion 230 is also fitted to the outside of the circumference of the coating member 220. Then, a gear portion 232 is formed in the shutter 231B. A gear portion 131 is also formed in a rack lever 130 provided in the image forming apparatus 100. It is to be noted the shutter 231A and the shutter 231B are formed of one member.

In a case where the processing unit 31 is moved in the direction indicated by the arrow 420 and is taken out from the image forming apparatus 100, a state of the shutter needs to be shifted from the state of FIG. 6 to the state of FIG. 7. This mechanism is now described below. When the rack lever 130 is moved in the direction indicated by an arrow 430, the gear portion 131 is also moved together. At that time, the gear portion 232 of the shutter 231B engages in the gear portion 131. Then, the shutter 231A rotates as the shutter 231B rotates, and the rotational force of the shutter 231A is transmitted to the coating member 220 through the tip portions 226A and 226B, so that the coating member 220 rotates.

That is, since the opening 221 of the coating member 220 is positioned in the part other than the vertical lower part in the state of FIG. 7, there is no possibility that waste toner falls down from the opening 221 when the processing unit 31 is moved in the direction indicated by the arrow 420 and is taken out from the image forming apparatus 100. This state is a required condition when the processing unit 31 is moved in the direction indicated by the arrow 420 and is taken out from the image forming apparatus 100.

Figure 8:
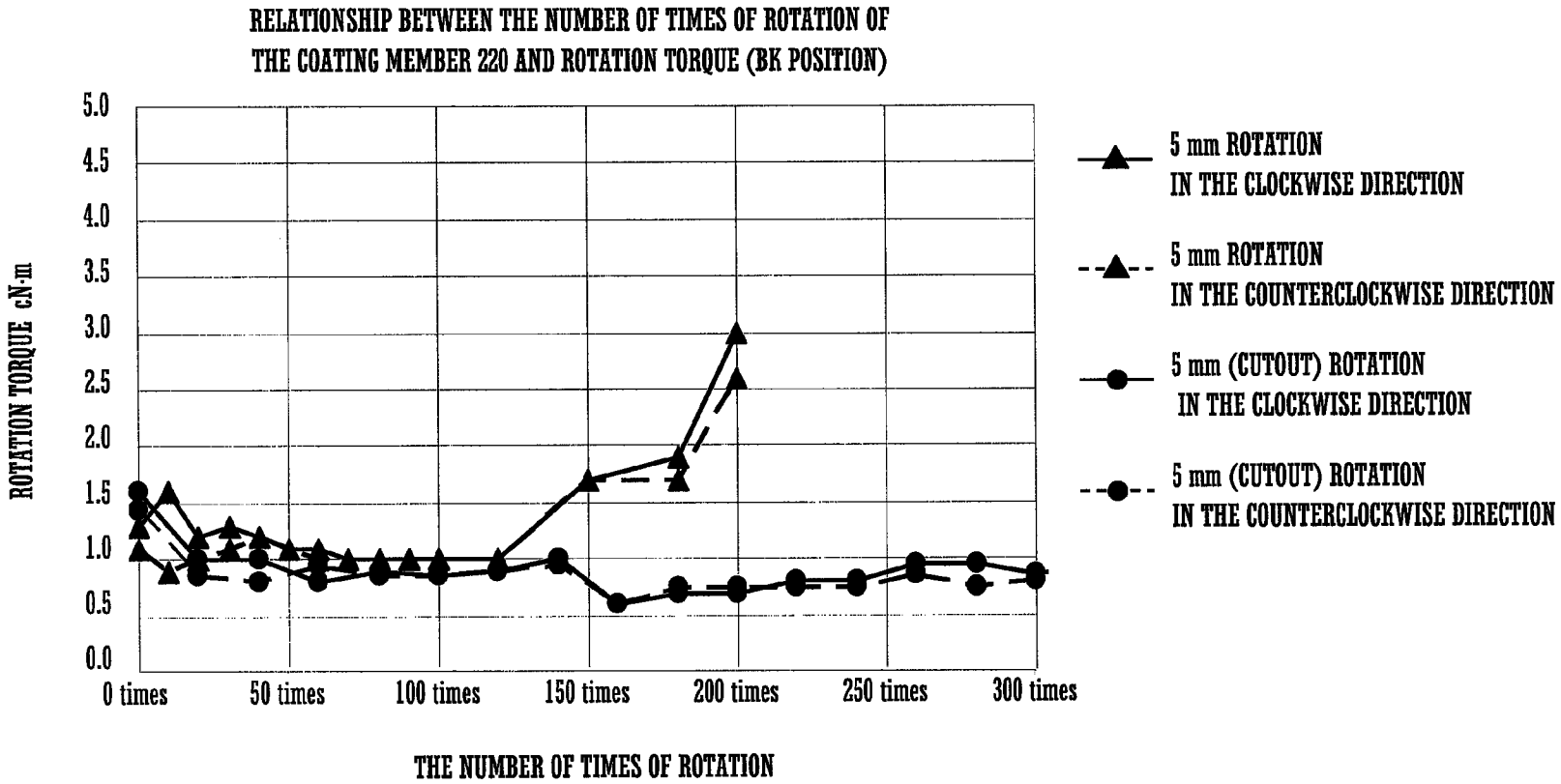
FIG. 8 is a graph showing a relationship between the number of times of rotation and rotation torque of the coating member in the waste toner recovery unit according to the first embodiment of the present invention.

FIG. 8 is a graph showing a relationship between the number of times of rotation and rotation torque of the coating member 220 in the waste toner recovery unit 200 according to the first embodiment of the present invention.

The graph shows comparison between the coating member 220 (5-mm (cutout) rotation in the clockwise direction and 5-mm (cutout) rotation in the counterclockwise direction) of the present embodiment, and a conventional coating member (5-mm rotation in the clockwise direction and 5-mm rotation in the counterclockwise direction). It is to be noted that the conventional coating member has no cutout portion 310 formed thereon. Moreover, the "5 mm" means the length of the fitting portion 222 in the axial direction is 5 mm.

This graph shows the difference between the coating member 220 and the conventional coating member begins to appear significantly from around a point where the number of times of rotation of the coating member 220 exceeds 120 times. That is to say, while the rotation torque of the conventional coating member rapidly increases from around a point where the number of times of rotation of the coating member exceeds 120 times, almost no change is observed in the rotation torque of the coating member 220 even when the number of times of rotation of the coating member 220 reaches 300 times.

The results of experiments prove that increase of the rotation torque accompanying the increase in the number of times of rotation of the coating member 220 can be prevented because the penetrating toner 227 which has been accumulated in the fitting portion 222 between the processing unit 31 and the coating member 220 can be scraped by the cutout portion 310 when the coating member 220 is rotated, thereby enabling the amount of the penetrating toner 227 which has been accumulated in the fitting portion 222 to be decreased.

Therefore, the waste toner recovery unit 200 according to the present embodiment can prevent operability from being deteriorated even when being used over a long period of time.

Subsequently, description will be made of a second embodiment of the present invention. In the second embodiment and the embodiments subsequent thereto, description of features common to the first embodiment is omitted to avoid duplication.

Figure 9:
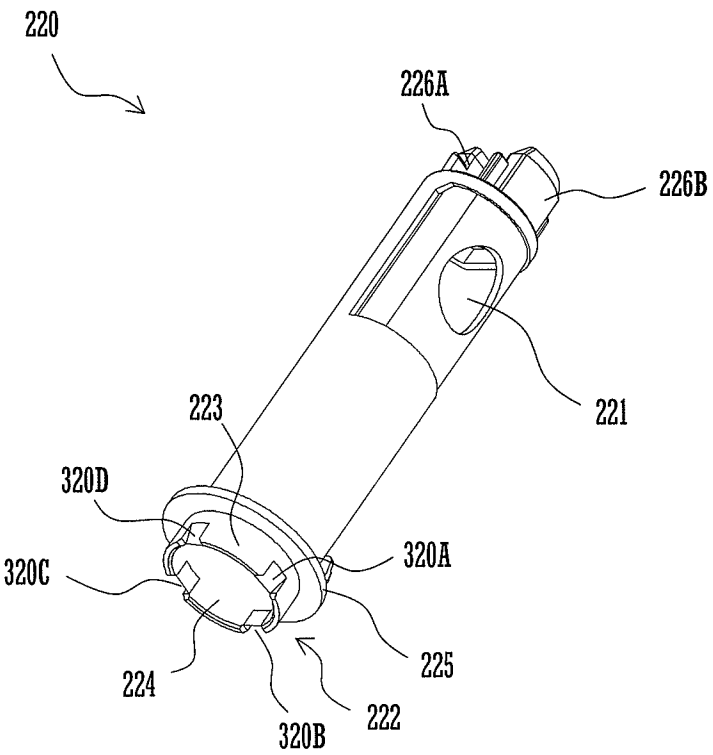
FIG. 9 is a view illustrating a configuration of a coating member in a waste toner recovery unit according to a second embodiment of the present invention.

FIG. 9 is a view of a configuration of a coating member 220 in a waste toner recovery unit 200 according to the second embodiment of the present invention.

A tapered portion is formed on cutout portions 320A to 320D so as to make a sliding surface 223 and an opposite side surface 224 approach toward a side end portion of a fitting portion 222 in the coating member 220.

In this configuration, since penetrating toner 227 which has been accumulated in the fitting portion 222 between the processing unit 31 and the coating member 220 can be scraped by the cutout portions 320A to 320D when the coating member 220 is rotated, the amount of the penetrating toner 227 which has been accumulated in the fitting portion 222 can be decreased. In addition, since the cutout portions 320A to 320D are formed of a predetermined tapered portion, the penetrating toner 227 which has been accumulated in the cutout portions 320A to 320D can be smoothly moved to the opposite side surface 224, that is, the waste toner conveying screw 210 side. Accordingly, increase of the rotation torque accompanying the increase in the number of times of rotation of the coating member 220 can be prevented.

Therefore, the waste toner recovery unit 200 according to the present embodiment can prevent operability from being deteriorated even when being used over a long period of time.

Subsequently, description will be made of a third embodiment of the present invention.

Figure 10:
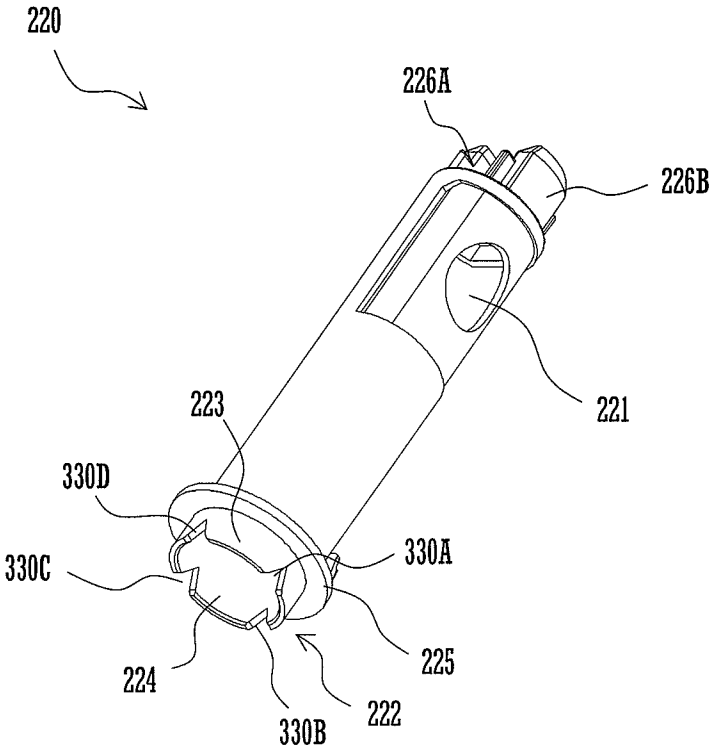
FIG. 10 is a view illustrating a configuration of a coating member in a waste toner recovery unit according to a third embodiment of the present invention.

FIG. 10 is a view of a configuration of a coating member 220 in a waste toner recovery unit 200 according to the third embodiment of the present invention.

Cutout portions 330A to 330D have a triangular shape.

In this configuration, since the width in a circumferential direction is widely secured, penetrating toner 227 which has been accumulated in a fitting portion 222 between a processing unit 31 and a coating member 220 can be scraped effectively when the coating member 220 is rotated. Accordingly, increase of the rotation torque accompanying the increase in the number of times of rotation of the coating member 220 can be prevented.

Therefore, the waste toner recovery unit 200 according to the present embodiment can prevent operability from being deteriorated even when being used over a long period of time.

Subsequently, description will be made of a fourth embodiment of the present invention.

Figure 11:
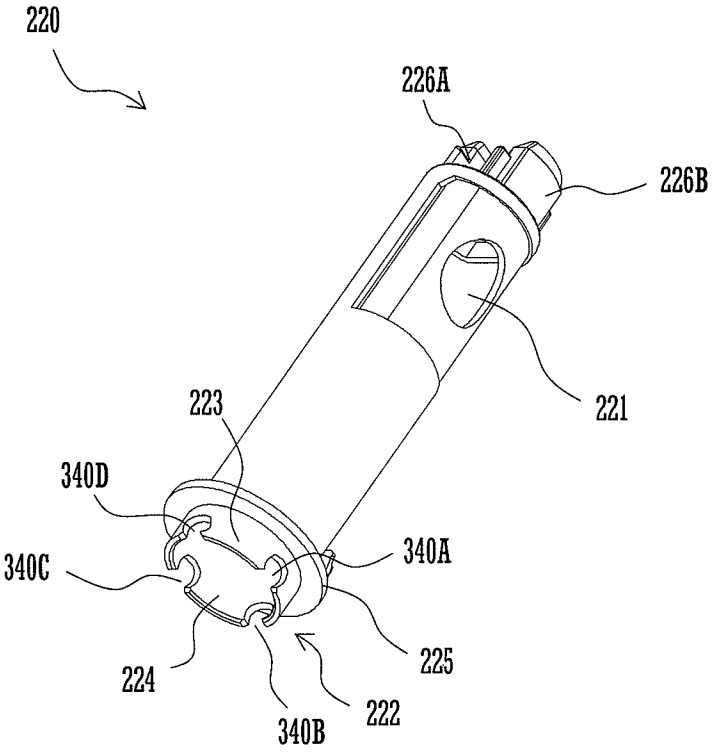
FIG. 11 is a view illustrating a configuration of a coating member in a waste toner recovery unit according to a fourth embodiment of the present invention.

FIG. 11 is a view of a configuration of a coating member 220 in a waste toner recovery unit 200 according to the fourth embodiment of the present invention.

Cutout portions 340A to 340D have an arc shape.

In this configuration, since the width in a circumferential direction is widely secured, the penetrating toner 227 which has been accumulated in the fitting portion 222 between the processing unit 31 and the coating member 220 can be scraped effectively when the coating member 220 is rotated. Accordingly, increase of the rotation torque accompanying the increase in the number of times of rotation of the coating member 220 can be prevented.

Therefore, the waste toner recovery unit 200 according to the present embodiment can prevent operability from being deteriorated even when being used over a long period of time.

Subsequently, description will be made of a fifth embodiment of the present invention.

Figure 12:
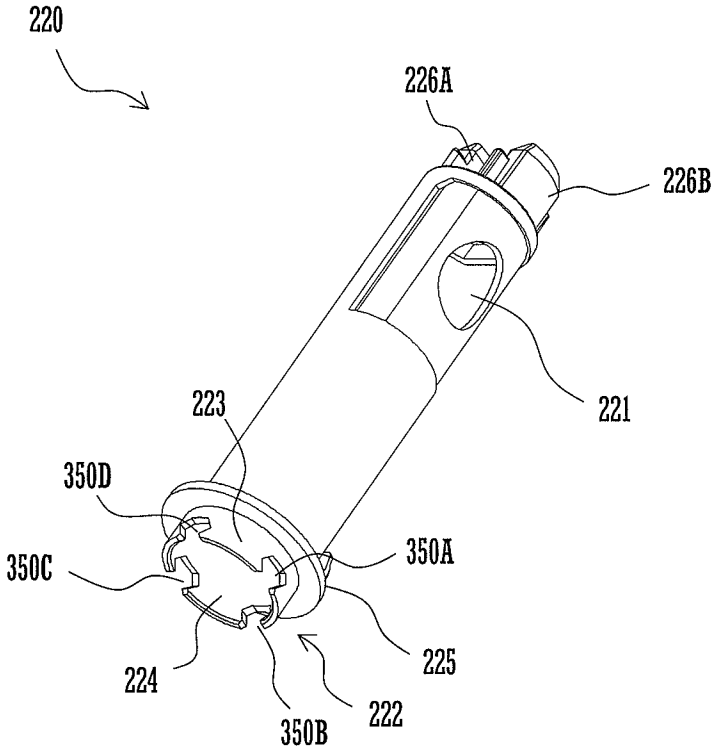
FIG. 12 is a view illustrating a configuration of a coating member in a waste toner recovery unit according to a fifth embodiment of the present invention.

FIG. 12 is a view of a configuration of a coating member 220 in a waste toner recovery unit 200 according to the fifth embodiment of the present invention.

Cutout portions 350A to 350D have a polygonal shape.

In this configuration, since the width in a circumferential direction is widely secured, the penetrating toner 227 which has been accumulated in the fitting portion 222 between the processing unit 31 and the coating member 220 can be scraped effectively when the coating member 220 is rotated. Accordingly, increase of the rotation torque accompanying the increase in the number of times of rotation of the coating member 220 can be prevented.

Therefore, the waste toner recovery unit 200 according to the present embodiment can prevent operability from being deteriorated even when being used over a long period of time.

The above described embodiments are to be considered in all respects as illustrative and not restrictive.

The scope of the present invention is defined not by above described embodiments but by the claims. Further, the scope of the present invention is intended to include all modifications that come within the meaning and scope of the claims and any equivalents thereof.

What is claimed is:

1. A waste toner recovery unit comprising:

a waste toner conveying screw having a first end and a second end, for conveying waste toner, the first end being linked to a driving portion and the second end being set as a free end;

a coating member for coating the free end of the waste toner conveying screw by being fitted in a processing unit, the coating member having an opening to which the waste toner conveyed by the waste toner conveying screw falls down and being capable of rotating in such a way that the opening is positioned in a vertically lower part; and a waste toner storing portion for storing the waste toner which falls down from the opening, wherein the coating member has at least one cutout portion formed at an end of a sliding surface of a fitting portion fitted in the processing unit, and the cutout portion is formed in a position where the cutout portion can pass through a vertically lower side by rotation of the coating member.

2. A waste toner recovery unit comprising:

a waste toner conveying screw having a first end and a second end, for conveying waste toner, the first end being linked to a driving portion and the second end being set as a free end;

a coating member for coating the free end of the waste toner conveying screw by being fitted in a processing unit, the coating member having an opening to which the waste toner conveyed by the waste toner conveying screw falls down and being capable of rotating in such a way that the opening is positioned in a vertically lower part; and a waste toner storing portion for storing the waste toner which falls down from the opening, wherein the coating member has at least one cutout portion formed at an end of a sliding surface of a fitting portion fitted in the processing unit, and the cutout portion is formed so that the sliding surface and an opposite side surface of the sliding surface can communicate with each other.

3. A waste toner recovery unit comprising:

a waste toner conveying screw having a first end and a second end, for conveying waste toner, the first end being linked to a driving portion and the second end being set as a free end;

a coating member for coating the free end of the waste toner conveying screw by being fitted in a processing unit, the coating member having an opening to which the waste toner conveyed by the waste toner conveying screw falls down and being capable of rotating in such a way that the opening is positioned in a vertically lower part; and a waste toner storing portion for storing the waste toner which falls down from the opening, wherein the coating member has at least one cutout portion formed at an end of a sliding surface of a fitting portion fitted in the processing unit, and the cutout portion includes a tapered portion which is formed so as to make the sliding surface and an opposite side surface of the sliding surface approach toward a side end portion of the fitting portion in the coating member.

4. The waste toner recovery unit according to claim 1, wherein the cutout portion is arranged at every predetermined angle according to a rotatable angle of the coating member.

5. The waste toner recovery unit according to claim 2, wherein the cutout portion is arranged at every predetermined angle according to a rotatable angle of the coating member.

6. The waste toner recovery unit according to claim 3, wherein the cutout portion is arranged at every predetermined angle according to a rotatable angle of the coating member.

* * * * *